US005810213A

United States Patent [19]

Flores et al.

[11] Patent Number: 5,810,213

[45] Date of Patent: Sep. 22, 1998

[54] PORTABLE PRESSURIZED RESERVOIR SUPPLY TANK

[76] Inventors: Salvador Flores, 8426 Berrycreek Dr., San Antonio, Tex. 78218; Ramiro O. Flores, 12787 Somerset Rd., Von Ormy, Tex. 78073

[21] Appl. No.: 786,716

[22] Filed: Jan. 21, 1997

[51] Int. Cl.[6] ..... B67D 5/64

[52] U.S. Cl. ..... 222/610; 222/397; 222/530; 222/626; 239/175; 239/373

[58] Field of Search ..... 222/396, 397, 222/608, 609, 610, 626, 529, 530; 239/172, 175, 373

[56] References Cited

U.S. PATENT DOCUMENTS

| | | | |
|---|---|---|---|
| 3,142,443 | 7/1964 | Morgan | 222/397 |
| 3,504,822 | 4/1970 | Haloski | 222/397 |
| 3,801,015 | 4/1974 | Hayes | 239/175 |
| 3,837,539 | 9/1974 | Schlegel | 222/609 |
| 3,940,065 | 2/1976 | Ware et al. | 222/626 |
| 4,089,446 | 5/1978 | Logan, II et al. | 239/172 |
| 5,667,113 | 9/1997 | Clarke et al. | 222/530 |

*Primary Examiner*—Philippe Derakshani

[57] ABSTRACT

A portable pressurized reservoir supply tank comprises a tank housing with a flat upper surface, a flat lower surface and a hollow interior, air and water being contained within the tank in an operative orientation, a pressure gauge being positioned through the tank housing, the pressure gauge including a mechanism to measure and indicate the air pressure within the hollow interior of the tank housing, a compressed air charging valve being positioned through the tank housing, the compressed air charging valve including a coupling mechanism, a pressure relief valve being positioned through the tank housing, a fill spout being positioned through the tank housing, a fill cap being coupled to the fill spout, a discharge assembly being formed in a cylindrical configuration with an outboard end including screw threads and an inboard end positioned through the tank housing adjacent the lower surface, the discharge assembly including a handle to regulate the flow of water therethrough.

2 Claims, 3 Drawing Sheets

PORTABLE PRESSURIZED RESERVOIR SUPPLY TANK

BACKGROUND OF THE INVENTION

1. Field of the Invention

The present invention relates to a portable pressurized reservoir supply tank and more particularly pertains to providing users with a mobile supply of pressurized water.

2. Description of the Prior Art

The use of water tanks is known in the prior art. More specifically, water tanks heretofore devised and utilized for the purpose of retaining water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,265,653 to Herlth discloses a portable pneumatic liquid transfer assembly.

U.S. Pat. No. 5,199,609 to Ash, Jr. discloses a portable dispensing system.

U.S. Pat. No. Des. 305,981 to Levee discloses the ornamental design for a liquid dispenser.

U.S. Pat. No. 4,775,241 to Stuckey discloses an integrated liquid distribution apparatus.

U.S. Pat. No. 5,146,783 to Jansche et al. discloses a liquid container hydrostatic level gauge.

U.S. Pat. No. 4,921,143 to Billet discloses a portable beverage dispenser.

While these devices fulfill their respective, particular objective and requirements, the aforementioned patents do not describe a portable pressurized reservoir supply tank for providing users with a mobile supply of pressurized water.

In this respect, the portable pressurized reservoir supply tank according to the present invention substantially departs from the conventional concepts and designs of the prior art, and in doing so provides an apparatus primarily developed for the purpose of providing users with a mobile supply of pressurized water.

Therefore, it can be appreciated that there exists a continuing need for new and improved portable pressurized reservoir supply tank which can be used for providing users with a mobile supply of pressurized water. In this regard, the present invention substantially fulfills this need.

SUMMARY OF THE INVENTION

In the view of the foregoing disadvantages inherent in the known types of water tanks now present in the prior art, the present invention provides an improved portable pressurized reservoir supply tank. As such, the general purpose of the present invention, which will be described subsequently in greater detail, is to provide a new and improved portable pressurized reservoir supply tank and method which has all the advantages of the prior art and none of the disadvantages.

To attain this, the present invention essentially comprises a new and improved portable pressurized reservoir supply tank comprising, in combination: a dolly having two side legs, a handle, two wheels and a frontwardly projecting base, each side leg having an upper extent and a lower extent, a wheel being rotatably coupled adjacent the lower extent of each leg, the base being formed in a planar generally rectangular configuration with an upper surface, a lower surface, a rear extent and a front extent, the rear extent of the base being coupled to the side legs adjacent the center point of the wheels, the handle being formed contiguously with the side legs and angled rearwardly with resect to the frontwardly projecting base, the handle including a downwardly extending hook, the base including two feet coupled to the lower surface thereof adjacent the front extent, the dolly including upper and lower securing belts coupled to the side legs, each belt including coupling means; a tank housing formed in a generally cylindrical configuration with a flat upper surface, a flat lower surface, a hollow interior and a rounded side wall, air and water being contained within the tank in an operative orientation, the upper surface of the tank housing including four apertures, a pressure gauge being positioned through a first aperture, the pressure gauge including means to measure and indicate the air pressure within the hollow interior of the tank housing, a compressed air charging valve being positioned through a second aperture, the compressed air charging valve including internal coupling means and external screw threads, a pressure relief valve being positioned through a third aperture, the pressure relief valve being essentially solid and having a small aperture extending therethrough in communication with the third aperture in the upper surface of the tank housing, a removable cap being coupled to the pressure relief valve, a fill spout being positioned through a fourth aperture, a fill cap being coupled to the fill spout, a lower aperture being positioned through the tank housing adjacent to the lower surface, a discharge assembly being formed in an elongated cylindrical configuration with an outboard end including screw threads and an inboard end positioned through the lower aperture of the tank housing, the discharge assembly including a handle to regulate the flow of water therethrough, in an operative orientation the tank housing being positioned upon the upper surface of the base of the dolly; a spray gun and water hose, the water hose having a first end coupled to the spray gun and a second end coupled to the outboard end of the discharge assembly, in an operative orientation a user turning the handle of the discharge assembly to permit the flow of water therethrough, the user activating the spray gun to direct water upon a desired surface; and an air pump with activation means and a twelve volt battery, the air pump including an output hose and two battery terminals, the battery terminals being coupled to the battery, the output hose having an outboard end including a coupling device couplable to the internal coupling means of the compressed air charging valve, in an operative orientation a user coupling the outboard end of the output hose to the compressed air charging valve and activating the device thereby causing air to forced through the output hose and into the tank housing, the user uncoupling the hose after attainment of the desired air pressure within the tank; the pressure relief valve protecting a user from overpressurizing the tank; a user removing the fill cap of the fill spout to fill the tank with the desired amount of water.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable pressurized reservoir supply tank which has all the advantages of the prior art water tanks and none of the disadvantages.

It is another object of the present invention to provide a new and improved portable pressurized reservoir supply tank which may be easily and efficiently manufactured and marketed.

It is a further object of the present invention to provide a new and improved portable pressurized reservoir supply tank which is of durable and reliable construction.

An even further object of the present invention is to provide a new and improved portable pressurized reservoir supply tank which is susceptible of a low cost of manufacture with regard to both materials and labor, and which accordingly is then susceptible of low prices of sale to the consuming public, thereby making such a portable pressurized reservoir supply tank economically available to the buying public.

Even still another object of the present invention is to provide a new and improved portable pressurized reservoir supply tank for providing users with a mobile supply of pressurized water.

Lastly, it is an object of the present invention to provide a new and improved portable pressurized reservoir supply tank comprising a tank housing with a flat upper surface, a flat lower surface and a hollow interior, air and water being contained within the tank in an operative orientation, a pressure gauge being positioned through the tank housing, the pressure gauge including means to measure and indicate the air pressure within the hollow interior of the tank housing, a pressure relief valve being positioned through the tank housing, the pressure relief valve including coupling means to relieve over-pressurizing of the tank; a compressed air charging valve being positioned through the tank housing, the compressed air charging valve including coupling means, a fill spout being positioned through the tank housing, a fill cap being coupled to the fill spout, a discharge assembly being formed in a cylindrical configuration with an outboard end including screw threads and an inboard end positioned through the tank housing adjacent the lower surface, the discharge assembly including a handle to regulate the flow of water therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
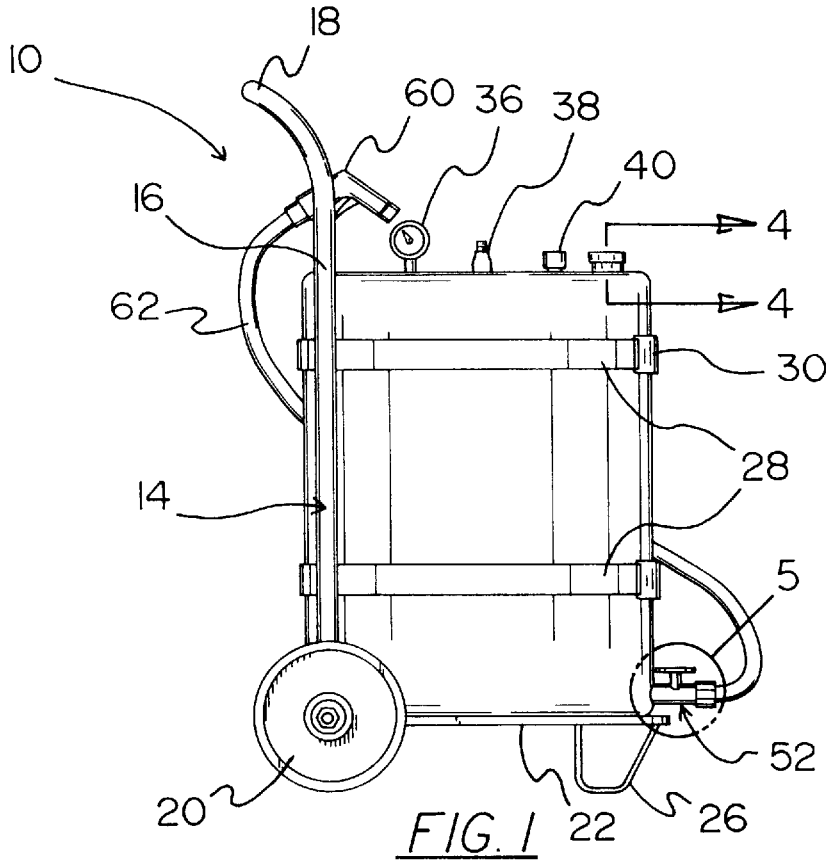
FIG. 1 is a perspective view of the preferred embodiment of the portable pressurized reservoir supply tank constructed in accordance with the principles of the present invention.

With reference now to the drawings, and in particular, to FIG. 1 thereof, the preferred embodiment of the new and improved portable pressurized reservoir supply tank embodying the principles and concepts of the present invention and generally designated by the reference number 10 will be described.

Specifically, it will be noted in the various Figures that the device relates to a portable pressurized reservoir supply tank 10. In its broadest context, the device consists of a tank housing 12 and a dolly 14. Such components are individually configured and correlated with respect to each other so as to attain the desired objective.

The portable pressurized reservoir supply tank 10 is designed to provide a portable outdoor supply of water that can be discharged under pressure. The apparatus is useful in a wide variety of applications, particularly for use with recreational vehicle and travel trailer water tanks. The portable pressurized reservoir supply tank can also be used to make an outdoor shower or wash stand, to transport and serve drinking water at athletic fields, recreation areas, parks, playgrounds, fairgrounds and festivals, washing cars, garden watering, etc. In alternate embodiments of the apparatus sprinkler, shower and water fountain attachments are coupled to the portable pressurized reservoir supply tank.

Figure 3:
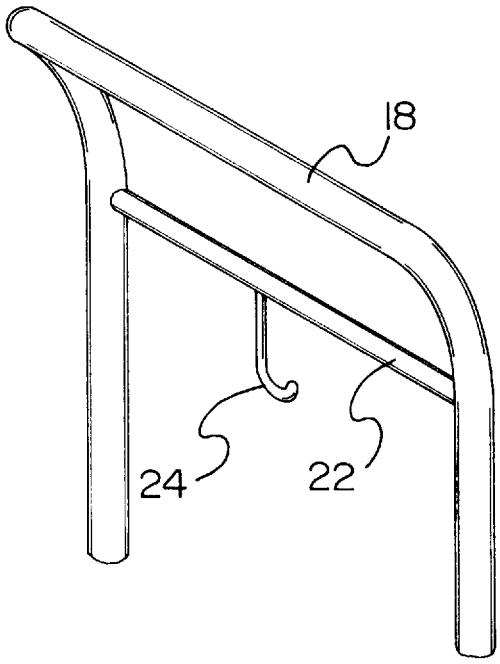
FIG. 3 is a perspective view of the handle of the dolly.

The dolly 14 of the apparatus has two side legs 16, a handle 18, two wheels 20 and a frontwardly projecting base 22. Each side leg has an upper extent and a lower extent. A wheel is rotatably coupled adjacent the lower extent of each leg. The base is formed in a planar, generally rectangular configuration with an upper surface, a lower surface, a rear extent and a front extent. The rear extent of the base is coupled to the side legs adjacent the center point of the wheels. Note FIGS. 1 and 3.

The handle 18 is formed contiguously with the side legs and is angled rearwardly with resect to the frontwardly projecting base. The rearwardly angled handle facilitates the user's ability to tip the dolly rearward when moving it. The handle includes a cross bar 23 and downwardly extending hook 24. The base includes two feet 26 which are coupled to the lower surface of the base adjacent its front extent. The dolly includes upper and lower securing belts 28 coupled to the side legs. Each belt includes buckles 30 to allow a user to securely couple the tank housing upon the base in an operative orientation. Note FIGS. 1 and 3.

Figure 2:
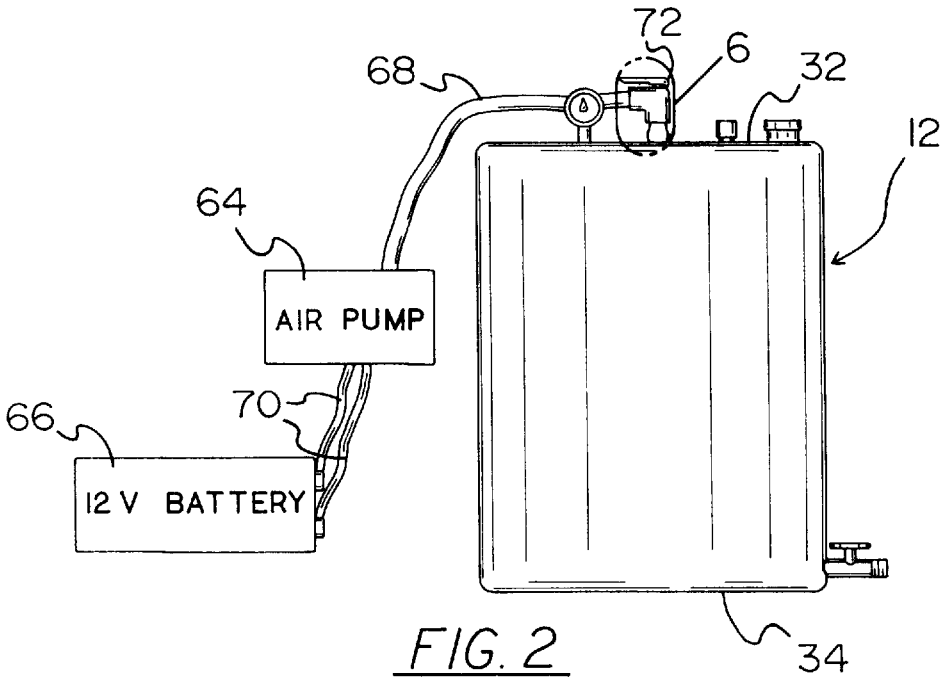
FIG. 2 is an isolated perspective view of the tank and air pump of the apparatus.

The tank housing is formed in a generally cylindrical configuration with a flat upper surface 32, a flat lower surface 34, a hollow interior and a rounded side wall. The desired amount of air and water are contained within the tank in an operative orientation. The more air that is contained within the tank housing the greater the water pressure when the discharge assembly is opened. In the preferred embodiment the tank can hold 33 gallons of water and will weigh about 275 pounds. The upper surface of the tank housing includes four apertures. A pressure gauge 36 is positioned through a first aperture. The pressure gauge includes means to measure and indicate the air pressure within the hollow interior of the tank housing. The pressure gauge is 100 PSI rated in the preferred embodiment. A compressed air charging valve 38 is positioned through a second aperture. The compressed air charging valve includes internal coupling means and external screw threads. The internal coupling means mate with the coupling device of the air pump output hose so that air can be forced into the tank housing but air cannot escape when the hose is uncoupled. Note FIGS. 2 and 6.

A pressure relief valve 40 is positioned through a third aperture. The pressure relief valve is essentially solid and has a small aperture 41 extending through it in communication with the third aperture in the upper surface of the tank housing. A removable cap 43 is coupled to the pressure relief valve. The air pump is coupled to the compressed air charging valve to permit the user to increase the pressure within the tank if desired. Note FIGS. 1, 2 and 6.

Figure 4:
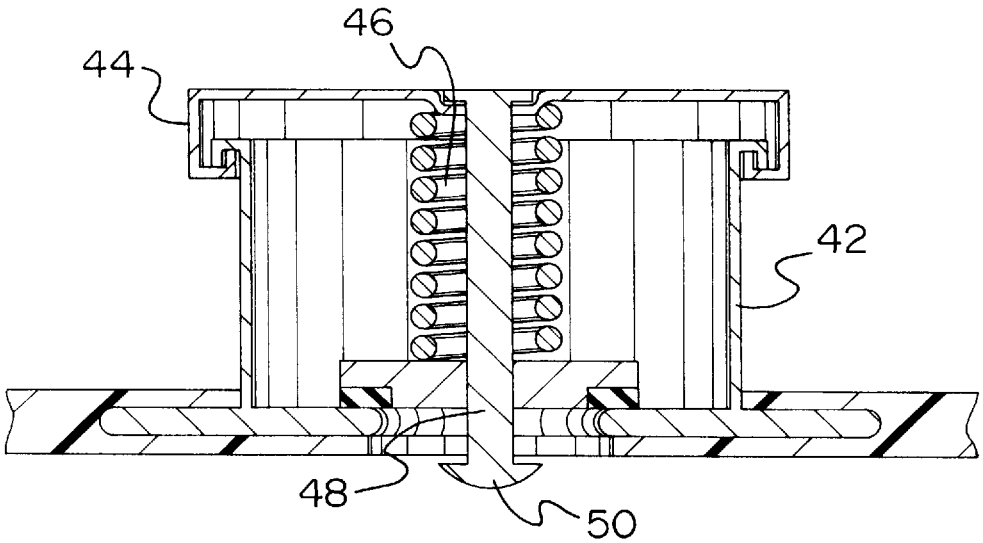
FIG. 4 is a cross sectional view of the fill cap of the apparatus.

A fill spout 42 is positioned through a fourth aperture. A fill cap 44 is coupled to the fill spout. The fill cap includes a spring 46 and a central post 48 with an outboard head 50. A user pushes the cap downward and turns it counterclockwise to remove the cap. The user then fills the tank with the desired amount of water. A conventional garden hose can be utilized for refilling purposes. Of course, air must be released from the tank before refilling can be accomplished. The tank housing is repressurized with air after water is placed within it. Note FIGS. 2 and 4.

Figure 5:
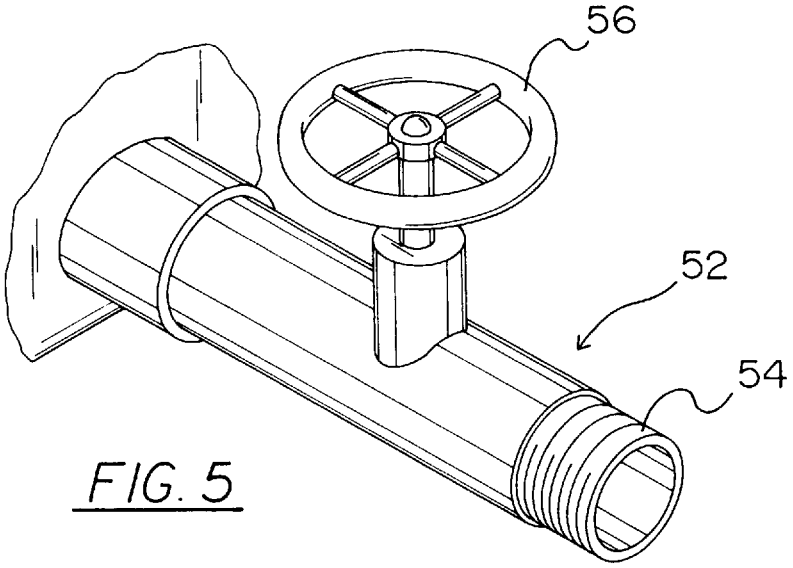
FIG. 5 is an isolated perspective view of the discharge assembly of the apparatus.

A lower aperture is positioned through the tank housing adjacent to the lower surface. A discharge assembly 52 is formed in an elongated cylindrical configuration with an outboard end 54 which includes screw threads and an inboard end which is positioned through the lower aperture of the tank housing. The discharge assembly includes a circular handle 56 to regulate the flow of water through it. The user simply turns the handle to allow water flow. In an operative orientation the tank housing is positioned upon the upper surface of the base of the dolly and secured in place by the belts. Note FIGS. 1, 4 and 5.

A spray gun 60 and water hose 62 are included with the apparatus. The water hose has a first end coupled to the spray gun and a second end coupled to the outboard end of the discharge assembly. In an operative orientation a user turns the handle of the discharge assembly to permit the flow of water through it. The user activates the spray gun to direct water upon a desired surface. In an operative orientation the discharge assembly is coupled to a plurality of different devices such as shower heads, sprinklers and drinking fountains. Note FIG. 1.

Figure 6:
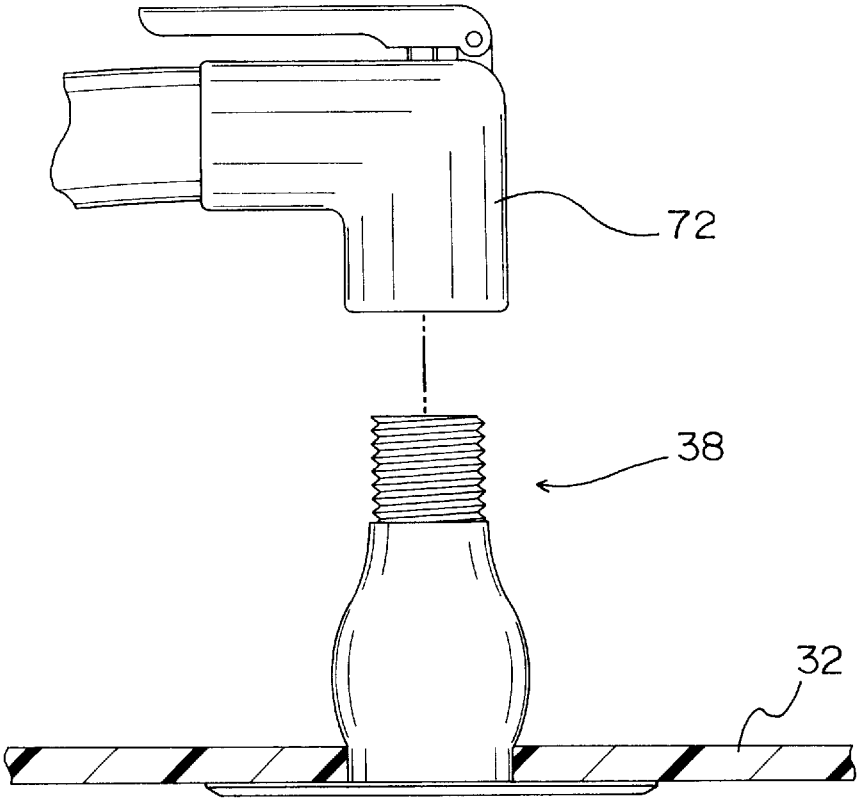
FIG. 6 is a side view of the air charging valve of the present invention.

An air pump 64 with activation means and a twelve volt battery 66 are included with the apparatus. The air pump includes an output hose 68 and two battery terminals 70. The battery terminals are coupled to the battery. Preferably, the battery is a vehicle battery and the terminals are connected to the battery via a conventional cigarette lighter. The output hose has an outboard end which includes a coupling device 72 couplable to the internal coupling means of the compressed air charging valve 38. As shown in FIG. 6, the coupling device of the output hose is equipped with a lever that may be conveniently depressed during the coupling of the coupling device to the air charging valve 38. The lever of the coupling device is similar to that utilized in the art of bicycle pumps and is adapted to temporarily enlarge an associated bushing within the coupling device 72 upon the depression thereof. Working in conjunction with the coupling device is a pin located within the air charging valve which is depressed only upon the securement of the coupling device to the air charging valve. Upon such depression, the pin allows air to enter the tank from the air pump. In an operative orientation a user couples the outboard end of the output hose to the compressed air charging valve and activates the device thereby causing air to forced through the output hose and into the tank housing. The user uncouples the hose after attainment of the desired air pressure within the tank. The pressure relief valve protects a user from over-pressurizing the tank. The pressure relief valve is conventional in nature like those found in the art of steam cooking. It should be noted that the pressure relief valve is adapted to release pressure upon the pressure inside the tank surpassing a predetermined amount. It should be further noted that the air pump and pressure gauge combination allows a user to closely regulate the pressure level within the tank housing. Note FIGS. 5 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved portable pressurized reservoir supply tank comprising, in combination:

a dolly having two side legs, a handle, two wheels and a frontwardly projecting base, each side leg having an upper extent and a lower extent, a wheel being rotatably coupled adjacent the lower extent of each leg, the base being formed in a planar generally rectangular configuration with an upper surface, a lower surface, a rear extent and a front extent, the rear extent of the base being coupled to the side legs adjacent the center point of the wheels, the handle being formed contiguously with the side legs and angled rearwardly with resect to the frontwardly projecting base, the handle including a downwardly extending hook, the base including two feet coupled to the lower surface thereof adjacent the front extent, the dolly including upper and lower securing belts coupled to the side legs, each belt including coupling means;

a tank housing formed in a generally cylindrical configuration with a flat upper surface, a flat lower surface, a hollow interior and a rounded side wall, air and water being contained within the tank in an operative orientation, the upper surface of the tank housing including four apertures, a pressure gauge being positioned through a first aperture, the pressure gauge including means to measure and indicate the air pressure within the hollow interior of the tank housing, a compressed air charging valve being positioned through a second aperture, the compressed air charging valve including internal coupling means and external screw threads, a pressure relief valve being positioned through a third aperture, the pressure relief valve being essentially solid and having a small aperture extending therethrough in communication with the third aperture in the upper surface of the tank housing, a removable cap being coupled to the pressure relief valve, a fill spout being positioned through a fourth aperture, a fill cap being coupled to the fill spout, a lower aperture being positioned through the tank housing adjacent to the lower surface, a discharge assembly being formed in an elongated cylindrical configuration with an outboard end including screw threads and an inboard end positioned through the lower aperture of the tank housing, the discharge assembly including a handle to regulate the flow of water therethrough, in an operative orientation the tank housing being positioned upon the upper surface of the base of the dolly;

a spray gun and water hose, the water hose having a first end coupled to the spray gun and a second end coupled to the outboard end of the discharge assembly, in an operative orientation a user turning the handle of the discharge assembly to permit the flow of water therethrough, the user activating the spray gun to direct water upon a desired surface; and an air pump with activation means and a twelve volt battery, the air pump including an output hose and two battery terminals, the battery terminals being coupled to the battery, the output hose having an outboard end including a coupling device couplable to the internal coupling means of the compressed air charging valve, in an operative orientation a user coupling the outboard end of the output hose to the compressed air charging valve and activating the device thereby causing air to be forced through the output hose and into the tank housing, the user uncoupling the hose after attainment of the desired air pressure within the tank; the pressure relief valve allowing a user to reduce the pressure within the tank by removing the cap therefrom; a user removing the fill cap of the fill spout to fill the tank with the desired amount of water.

2. A portable pressurized reservoir supply tank comprising:

a tank housing with a flat upper surface, a flat lower surface and a hollow interior, air and water being contained within the tank in an operative orientation, a pressure gauge being positioned through the tank housing, the pressure gauge including means to measure and indicate the air pressure within the hollow interior of the tank housing, a compressed air charging valve being positioned through the tank housing, the compressed air charging valve including coupling means to pressure the tank, a fill spout being positioned through the tank housing, a fill cap being coupled to the fill spout, a pressure relief valve being positioned through the tank housing, the pressure relief valve including coupling means to relieve over-pressurizing of the tank, a discharge assembly being formed in a cylindrical configuration with an outboard end including screw threads and an inboard end positioned through the tank housing adjacent the lower surface, the discharge assembly including a handle to regulate the flow of water therethrough; and a dolly having two side legs, a handle, two wheels and a frontwardly projecting base, each side leg having an upper extent and a lower extent, a wheel being rotatably coupled adjacent the lower extent of each leg, the base being formed in a planar generally rectangular configuration with an upper surface, a lower surface, a rear extent and a front extent, the rear extent of the base being coupled to the side legs adjacent the center point of the wheels, the handle being formed contiguously with the side legs and angled rearwardly with resect to the frontwardly projecting base, the handle including a downwardly extending hook, the base including two feet coupled to the lower surface thereof adjacent the front extent, the dolly including upper and lower securing belts coupled to the side legs, each belt including coupling means, in an operative orientation the tank housing being positioned upon the upper surface of the base of the dolly.

* * * * *